US010906792B2

(12) United States Patent
Karras

(10) Patent No.: US 10,906,792 B2
(45) Date of Patent: Feb. 2, 2021

(54) CAN PIERCING TOOL

(71) Applicant: John G. Karras, Surf City, NJ (US)

(72) Inventor: John G. Karras, Surf City, NJ (US)

( * ) Notice: Subject to any disclaimer, the term of this patent is extended or adjusted under 35 U.S.C. 154(b) by 177 days.

(21) Appl. No.: 15/987,258

(22) Filed: May 23, 2018

(65) Prior Publication Data

US 2019/0359464 A1 Nov. 28, 2019

(51) Int. Cl.
*B67B 7/00* (2006.01)
*B44D 3/12* (2006.01)

(52) U.S. Cl.
CPC . *B67B 7/24* (2013.01); *B44D 3/12* (2013.01)

(58) Field of Classification Search
CPC .... B67B 7/24; B44D 3/12; B44D 3/00; B44D 3/128
USPC ..... 30/358, 359, 366, 443, 446; 7/152
See application file for complete search history.

(56) References Cited

U.S. PATENT DOCUMENTS 580,916 A 4/1897 Westerfield et al.
1,024,403 A * 4/1912 Hill ..... B67B 7/12 81/3.48
1,861,438 A * 6/1932 Grisko ..... B67B 7/24 30/446
1,887,592 A 11/1932 Goodfellow
1,959,862 A * 5/1934 Grisko ..... B65D 17/4012 30/446
2,029,607 A 2/1936 Brenner
2,576,505 A * 11/1951 Engle ..... B67B 7/24 30/446
2,627,111 A * 2/1953 McDevitt ..... B67B 7/24 30/446
2,709,022 A 5/1955 Fatke
2,784,488 A * 3/1957 Olson ..... B65D 17/521 30/446
2,885,108 A * 5/1959 Donoghue ..... B44D 3/128 220/798
2,957,601 A * 10/1960 Novick ..... B65D 21/0224 206/503
3,043,171 A * 7/1962 Lederer ..... B25B 27/0042 81/176.15
3,074,592 A * 1/1963 Stocking ..... B67B 7/24 220/278
3,888,068 A * 6/1975 Zambrano ..... B26F 1/3846 30/358
4,182,151 A * 1/1980 Pedersen ..... B44D 3/12 30/446
4,580,302 A * 4/1986 Barth ..... B67B 7/24 30/366

(Continued)

FOREIGN PATENT DOCUMENTS

GB 145912 10/1919
WO WO 93/24405 * 12/1993
WO WO 2019/226924 A1 * 11/2019

OTHER PUBLICATIONS

International Search Report dated Aug. 9, 2019 for PCT/US 1933805.

*Primary Examiner* — Hwei-Siu C Payer
(74) *Attorney, Agent, or Firm* — Dovas Law, P.C.

(57) ABSTRACT

A can piercing tool including an annular ring and a plurality of pointed punches connected to the annular ring, concentric with the annular ring, inside the annular ring, and defining a circular perimeter. The tool includes a handle connected to the annular ring extending away from the annular ring.

23 Claims, 16 Drawing Sheets

(56) References Cited

U.S. PATENT DOCUMENTS

| | | | | | |
|---|---|---|---|---|---|
| 4,631,769 | A * | 12/1986 | White | B67B 3/22 | 30/366 |
| 4,911,038 | A | 3/1990 | Ferrin | | |
| 5,123,565 | A * | 6/1992 | Majewski | B44D 3/128 | 220/287 |
| 5,212,869 | A | 5/1993 | Zacharchuk | | |
| 5,535,657 | A * | 7/1996 | Bystrom | B67B 7/24 | 30/361 |
| 6,237,227 | B1 * | 5/2001 | Pojunas, Sr. | B26F 1/32 | 30/366 |
| 6,971,180 | B2 * | 12/2005 | Yocum | B65B 69/0033 | 30/366 |
| 2006/0042718 | A1 * | 3/2006 | Crain | B67B 7/30 | 141/51 |
| 2019/0359464 | A1 * | 11/2019 | Karras | B44D 3/00 | |

* cited by examiner

CAN PIERCING TOOL

BACKGROUND

Common paint cans are typically constructed of steel, aluminum or a polymeric material. These cans are available in a variety of sizes, for example gallon, quart, and pint, and are generally used in the storing of paints, finishes, and solvents. The cans include an annular channel around the opening for receiving a mating annular rim of a lid, which annular rim is wedged into the annular channel of the can to create an airtight seal preventing evaporation of the can contents. Opening a paint can entails prying the lid off of the can with a screwdriver or other thin flat-edged tool. When accessing a liquid from the can, the liquid tends to pool in the can's annular channel. Liquid may accumulate in the annular channel for example as a result of pouring liquid out of the can or dripping liquid from a paint brush or other applicator dipped into the can. Inconveniently, this liquid must be cleared from the channel prior to replacing the lid, or the liquid may splash out of the can, or the can may not be properly closed.

SUMMARY

This Summary introduces simplified concepts that are further described below in the Detailed Description of Illustrative Embodiments. This Summary is not intended to identify key features or essential features of the claimed subject matter and is not intended to be used to limit the scope of the claimed subject matter.

A can piercing tool is provided including an annular ring and a plurality of pointed punches connected to the annular ring, concentric with the annular ring, inside the annular ring, and defining a circular perimeter. The tool includes a handle connected to the annular ring extending away from the annular ring.

Further provided is a method of can modification. The method includes providing a cylindrical can including an annular channel around an opening of the cylindrical can. Further, a tool is provided including an annular ring, including a plurality pointed punches connected to the annular ring, concentric with the annular ring, inside the annular ring, and defining a circular perimeter, and including a handle connected to the annular ring extending away from the annular ring. The tool is positioned over the cylindrical can using the handle with the annular ring surrounding the cylindrical can and the plurality of pointed punches disposed within the annular channel of the cylindrical can. Force is applied to the plurality of pointed punches to pierce the annular channel of the cylindrical can.

BRIEF DESCRIPTION OF THE DRAWING(S)

A more detailed understanding may be had from the following description, given by way of example with the accompanying drawings. The Figures in the drawings and the detailed description are examples. The Figures and the detailed description are not to be considered limiting and other examples are possible. Like reference numerals in the Figures indicate like elements wherein.

DETAILED DESCRIPTION OF ILLUSTRATIVE EMBODIMENT(S)

Figure 1:
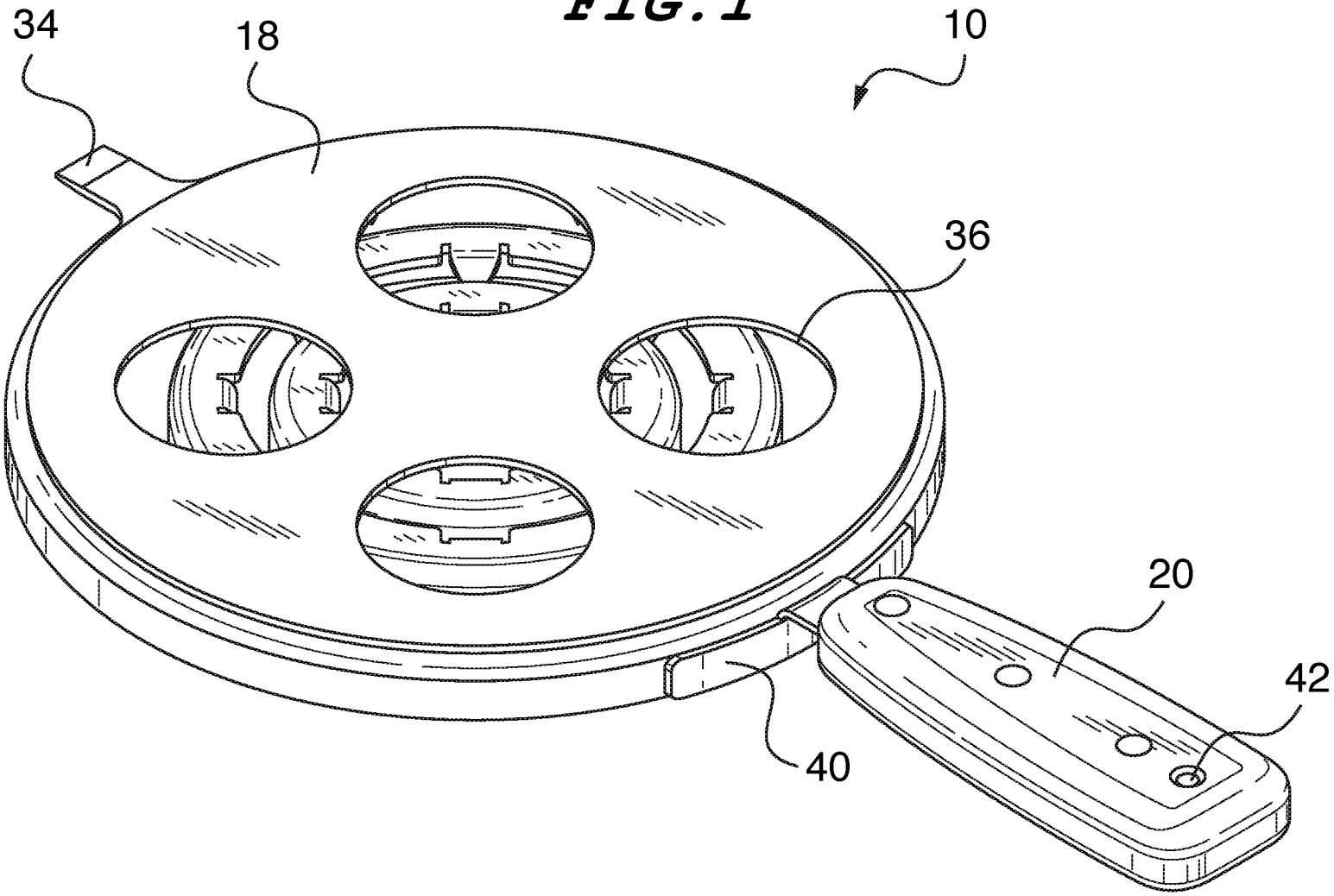
FIG. 1 is a top perspective view of a can piercing tool according to an illustrative embodiment.
Figure 2:
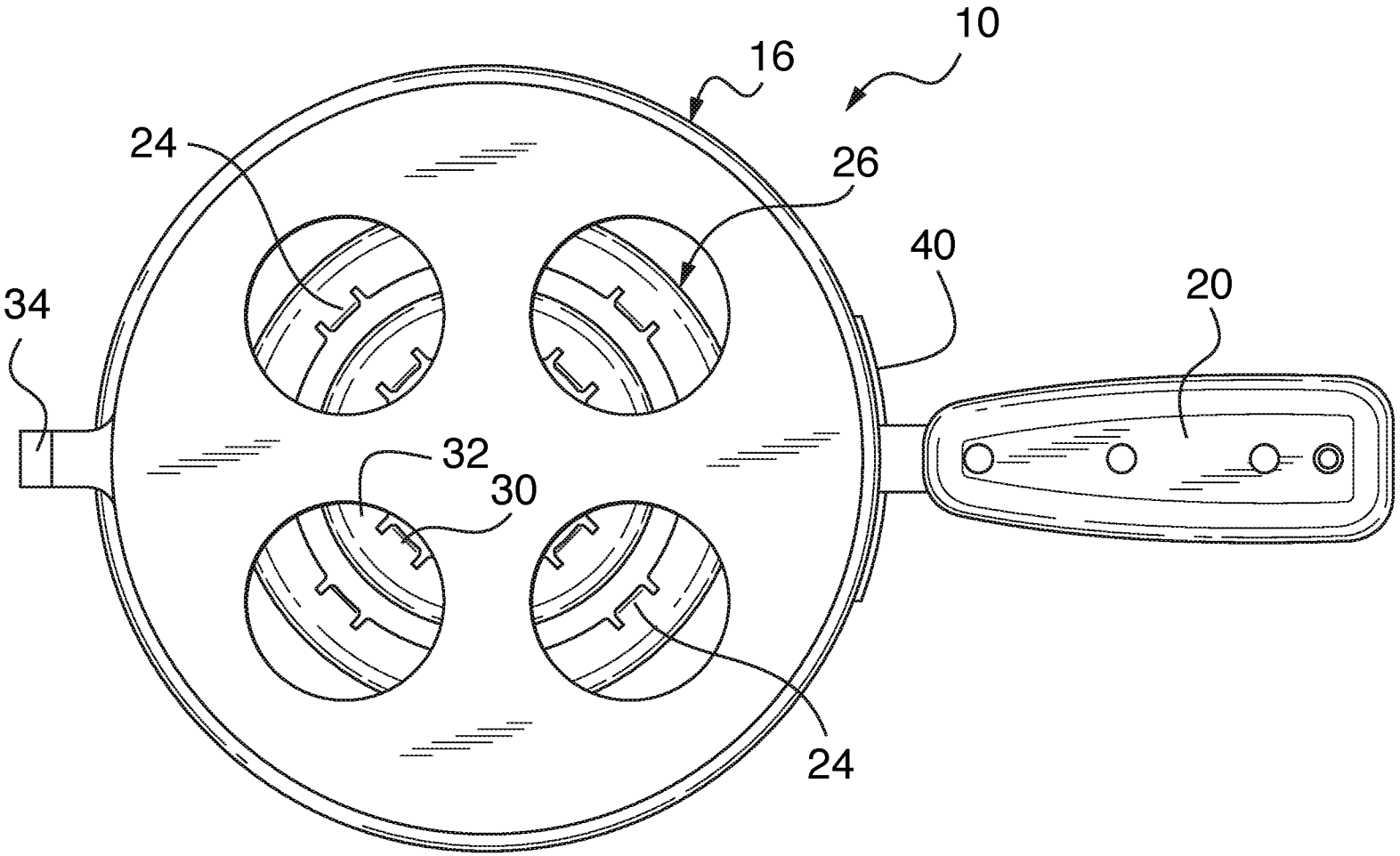
FIG. 2 is a top plan view of the tool of FIG. 1.
Figure 3:
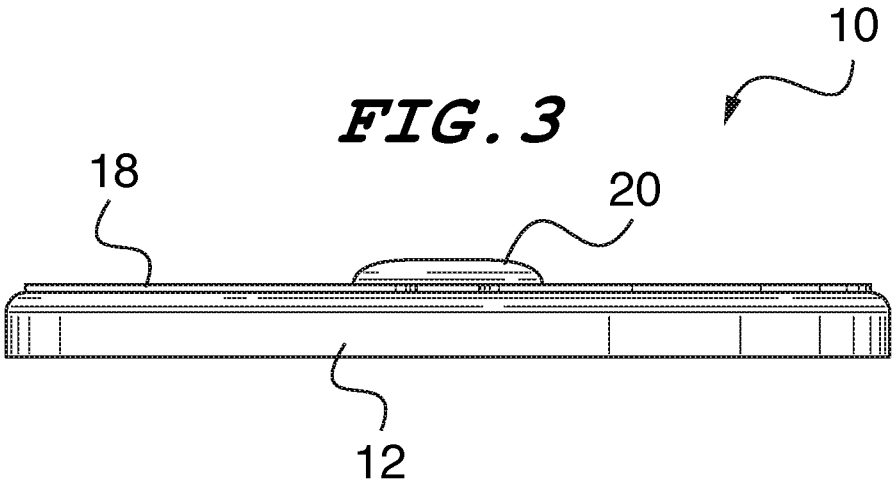
FIG. 3 is a front elevation view of the tool of FIG. 1.
Figure 4:
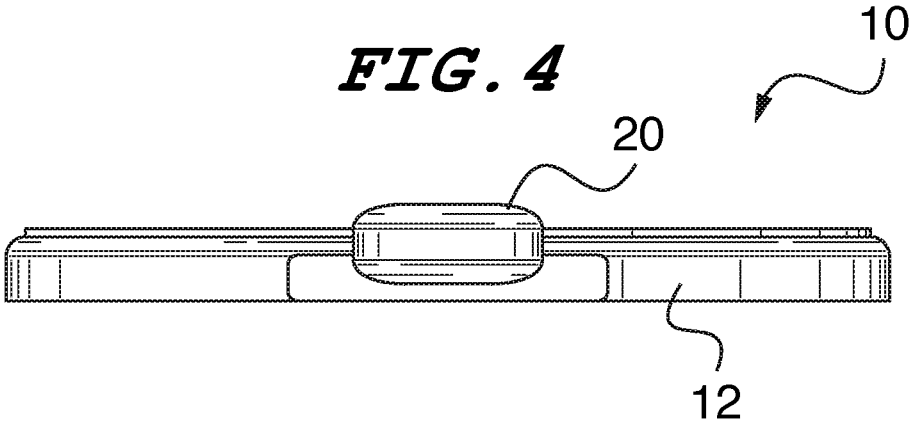
FIG. 4 is a rear elevation view of the tool of FIG. 1.
Figure 5:
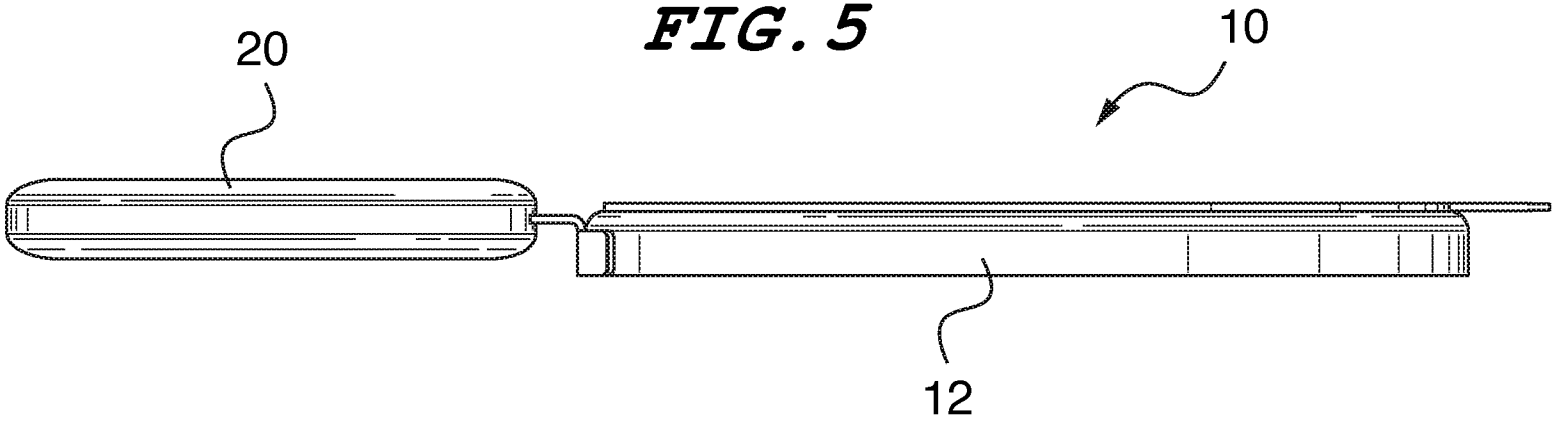
FIG. 5 is a right elevation view of the tool of FIG. 1.
Figure 6:
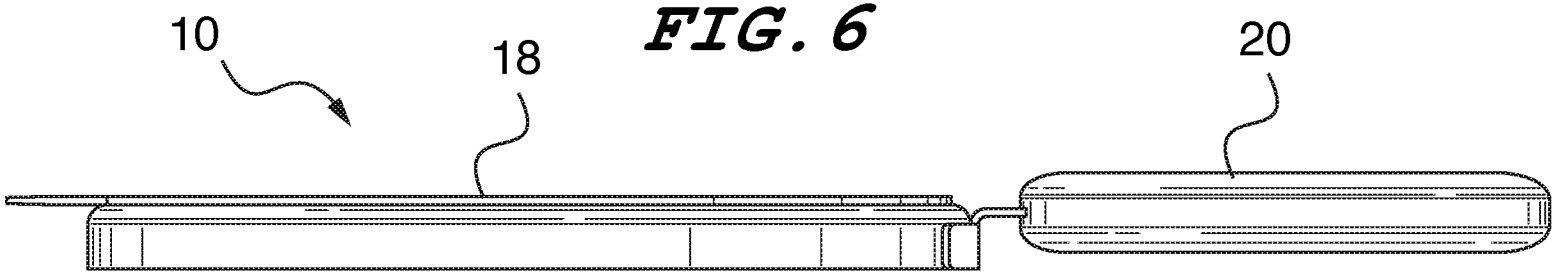
FIG. 6 is a left elevation view of the tool of FIG. 1.
Figure 7:
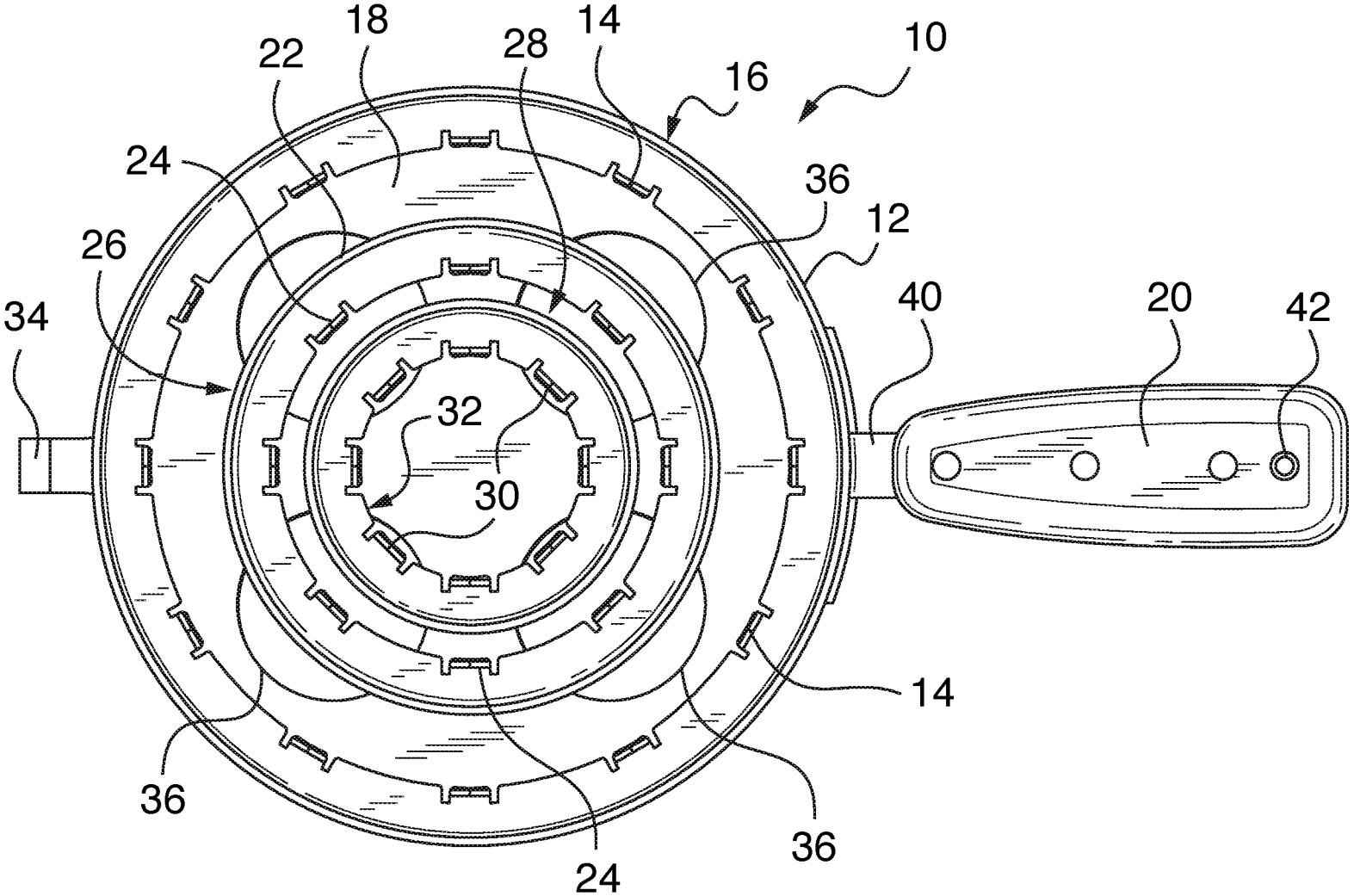
FIG. 7 is a bottom plan view of the tool of FIG. 1.
Figure 8:
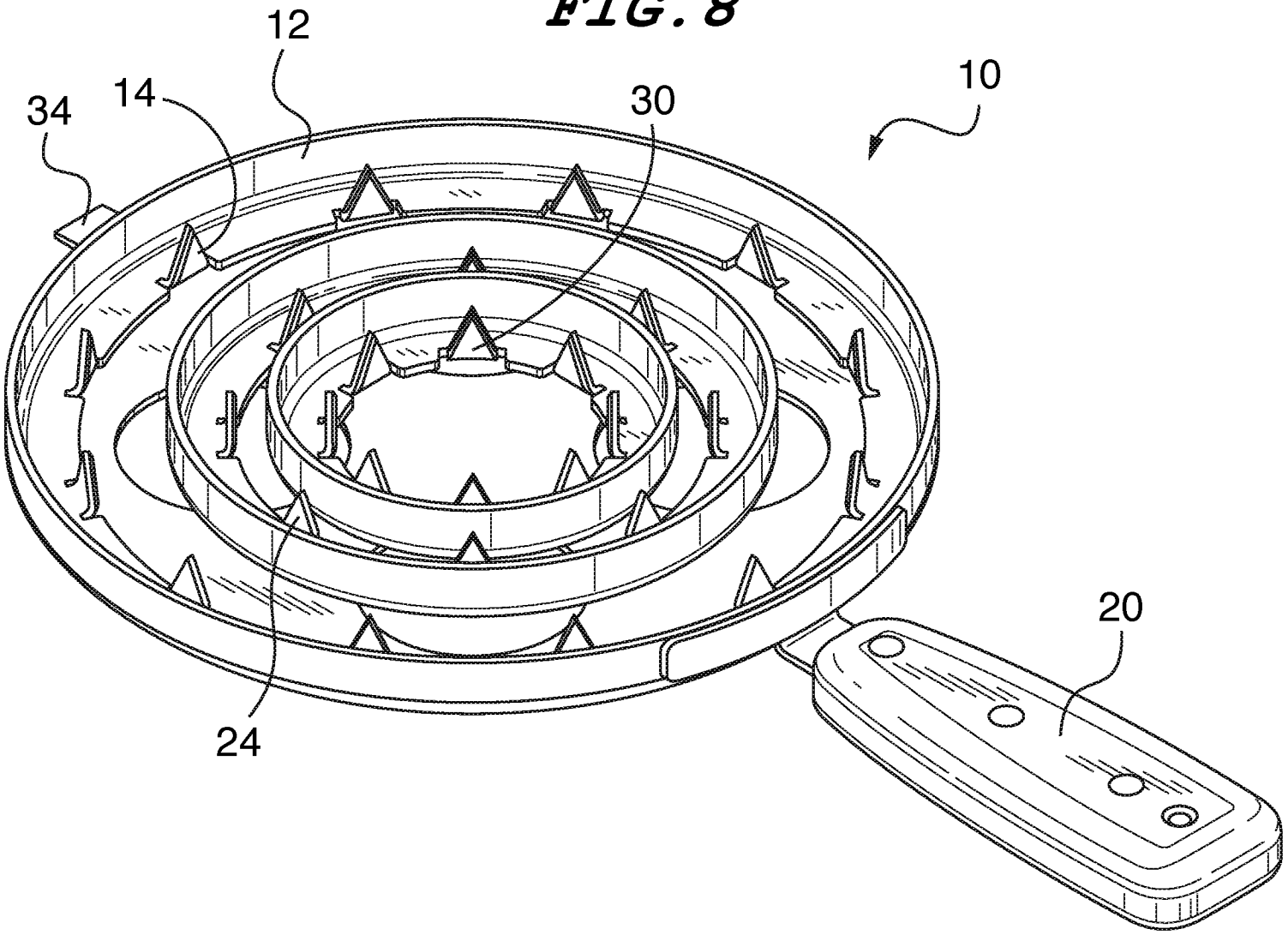
FIG. 8 is a bottom perspective view of the tool of FIG. 1.

Illustrative embodiments are described below with reference to the drawing figures wherein like numerals represent like elements throughout. The terms "a" and "an" as used herein do not denote a limitation of quantity, but rather denote the presence of at least one of the referenced items. Any directional signal such as top, bottom, left, right, upper and lower are taken with reference to the orientation in the various figures.

Referring to FIGS. 1 through 8, a can piercing tool (hereinafter "tool") 10 is shown according to an illustrative embodiment. The tool 10 includes a first annular ring 12. A first plurality of pointed punches 14 are connected to the first annular ring 12. In the embodiment shown, there are twelve (12) pointed punches 14. The first plurality of pointed punches 14 as shown are concentric with the first annular ring 12, positioned inside the first annular ring 12, and equally spaced from the first annular ring 12. The first plurality of pointed punches 14 define a first circular perimeter. The first annular ring 12 and the first plurality of pointed punches 14 as shown form a circular u-shaped sheet 16 connected to a circular plate 18. A handle 20 is connected to the first annular ring extending away from the first annular ring and substantially coplanar with a plane defined by the first annular ring 12. The handle 20 includes a connecting tab 40 which facilitates attachment of the handle to the first annular ring 12.

A second annular ring 22 is connected to the first annular ring 12 via the plate 18. The second annular ring 22 is coplanar with the first annular ring 12 and positioned inside the first circular perimeter defined by the first plurality of pointed punches 14. A second plurality of pointed punches 24 are connected to the second annular ring 22, concentric with the second annular ring 22, positioned inside the second annular ring 22, and equally spaced from the second annular ring 22. The second plurality of pointed punches 24 define a second circular perimeter. In the embodiment shown, there are eight (8) pointed punches 24. The second annular ring 22 and the second plurality of pointed punches 24 as shown form a circular u-shaped sheet 26 connected to the plate 18.

A third annular ring 28 is connected to the first annular ring 12 via the plate 18. The third annular ring 28 is coplanar with the first annular ring 12 and the second annular ring 22 and positioned inside the second circular perimeter defined by the second plurality of pointed punches 24. A third plurality of pointed punches 30 are connected to the third annular ring 28, concentric with the third annular ring 28, positioned inside the third annular ring 28, and equally spaced from the third annular ring 28. In the embodiment shown, there are eight (8) pointed punches 30. The third plurality of pointed punches 30 define a third circular perimeter. The third annular ring 28 and the third plurality of pointed punches 30 as shown form a circular u-shaped sheet 32 connected to the plate 18.

The first annular ring 12, the second annular ring 22, and the third annular ring 28 are concentric. The first circular perimeter, the second circular perimeter, and the third circular perimeter respectively defined by the first plurality of pointed punches 14, the second plurality of pointed punches 24, and the third plurality of pointed punches 30 are also concentric as shown. As such the annular rings 12, 22, 28 are all concentric with the circular perimeters defined by the plurality of pointed punches 14, 24, 30.

The plate 18 includes a narrow blade 34 connected to and extending away from the first annular ring 12 and the handle 20. The plate 18 further includes four (4) circular apertures 36 exposing the second annular ring 22, the third annular ring 28, four (4) of the second plurality of pointed punches 24, and four (4) of the third plurality of pointed punches 30 as shown for example in the views of FIG. 1 and FIG. 2. The apertures 36 are preferably annularly arranged along a fourth circular perimeter running through the centers of the apertures 36, the fourth circular perimeter being concentric with the first annular ring 12, the second annular ring 22, the third annular ring 28, and the first circular perimeter, the second circular perimeter, and the third circular perimeter respectively defined by the first plurality of pointed punches 14, the second plurality of pointed punches 24, and the third plurality of pointed punches 30. The positioning of the apertures 36 in such manner allows for structural rigidity of the tool 10 to be maintained while providing necessary visibility for a user to align the second and third annular rings 22, 28 when the device is in use.

The circular u-shaped sheets 16, 26, 32, including the annular rings 12, 22, 28 and the plurality of pointed punches 14, 24, 30, the plate 18, and the connecting tab 40 are beneficially constructed of metallic material, such as a high strength steel, and are beneficially connected by welding. While shown as sharply pointed, the punches 14, 24, 30 can alternatively be less sharply pointed, or dully pointed for example with radiused or chamfered points. The handle 20 can include for example a polymeric, wood, metal, or composite material.

Figure 9A:
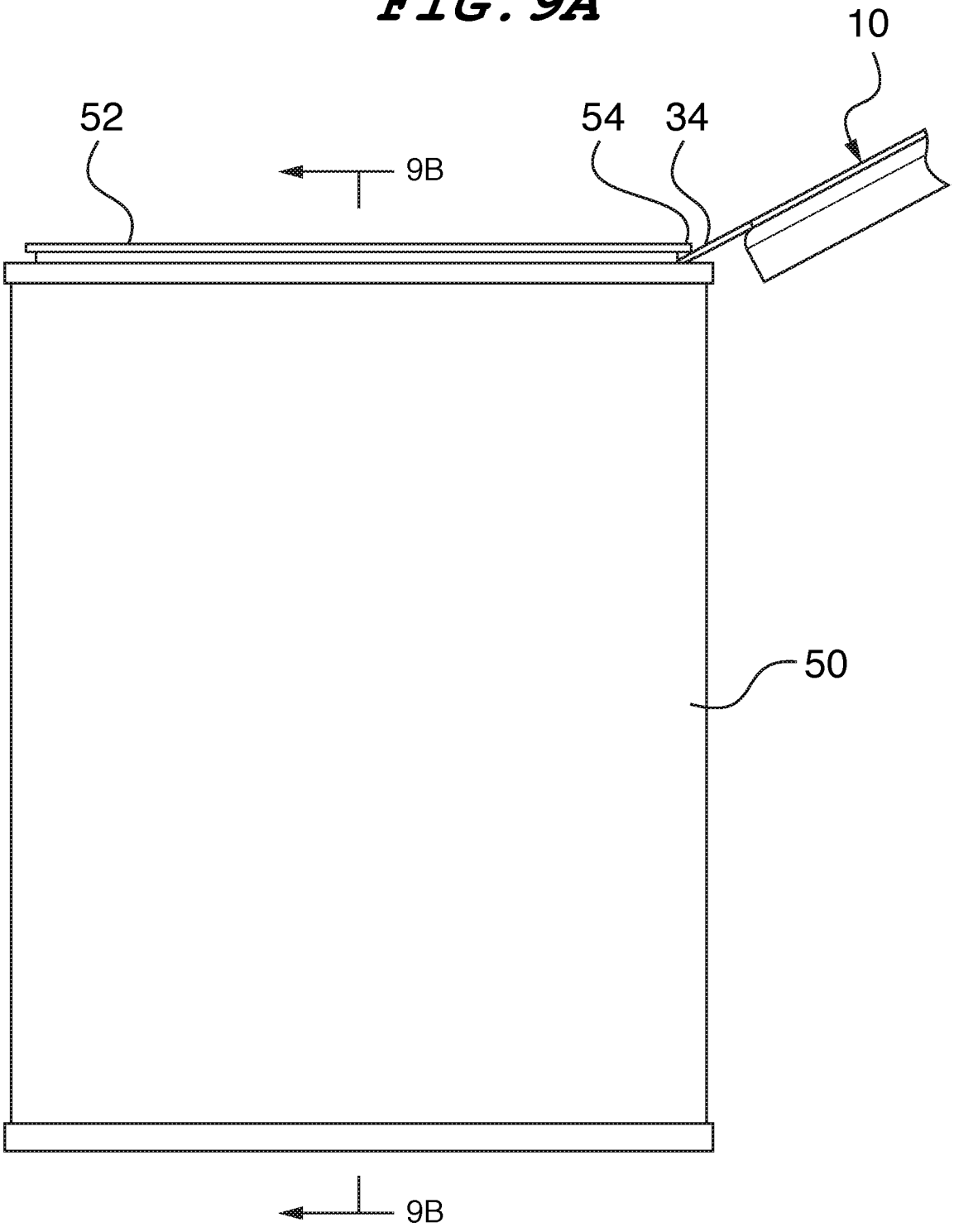
FIG. 9A is an illustration showing the tool of FIG. 1 positioned to remove a lid off of a cylindrical can shown in an elevation view.
Figure 9B:
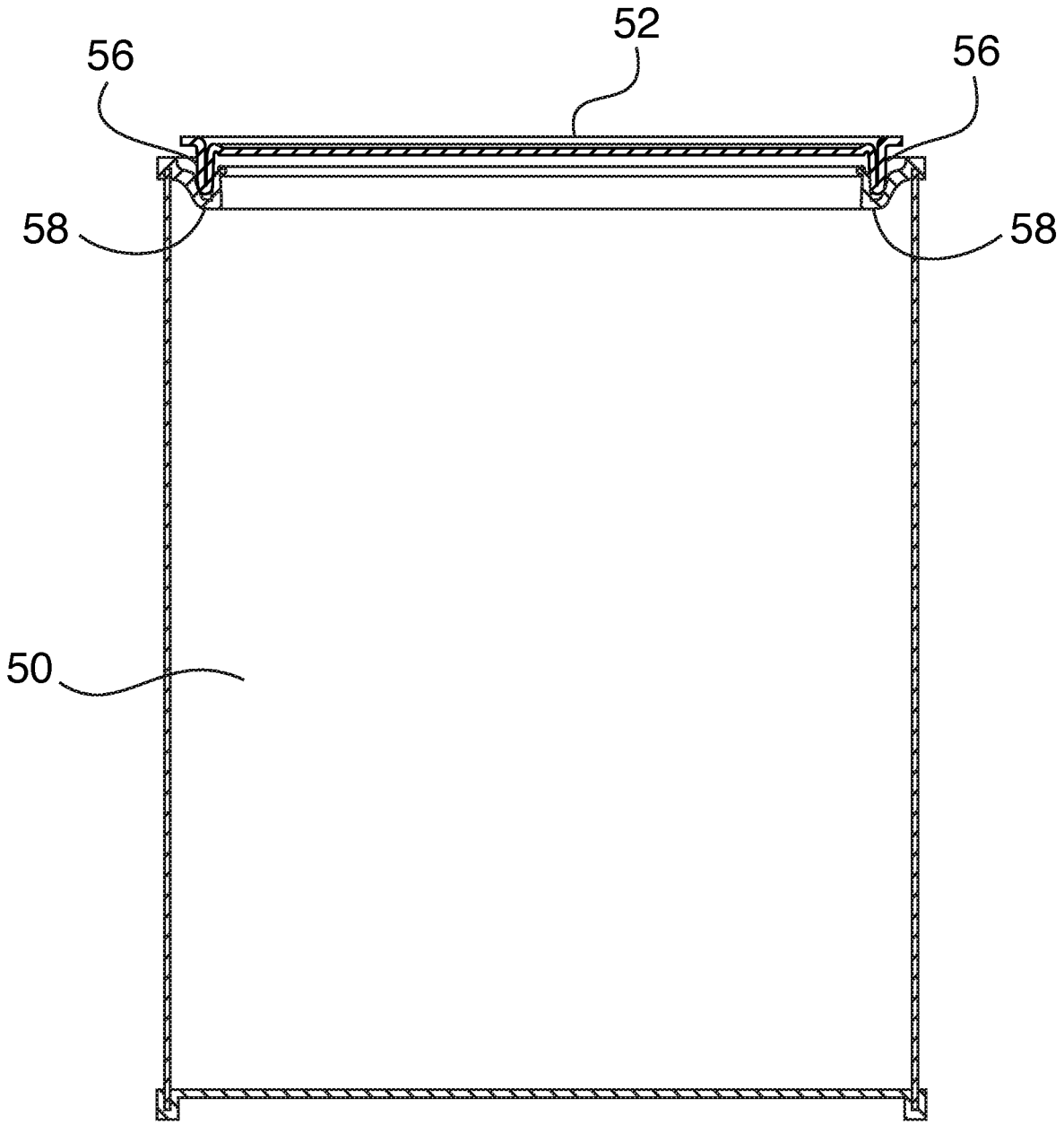
FIG. 9B is a cross-section view of the cylindrical can and the lid of FIG. 9A taken along line 9B-9B in FIG. 9A.
Figure 10A:
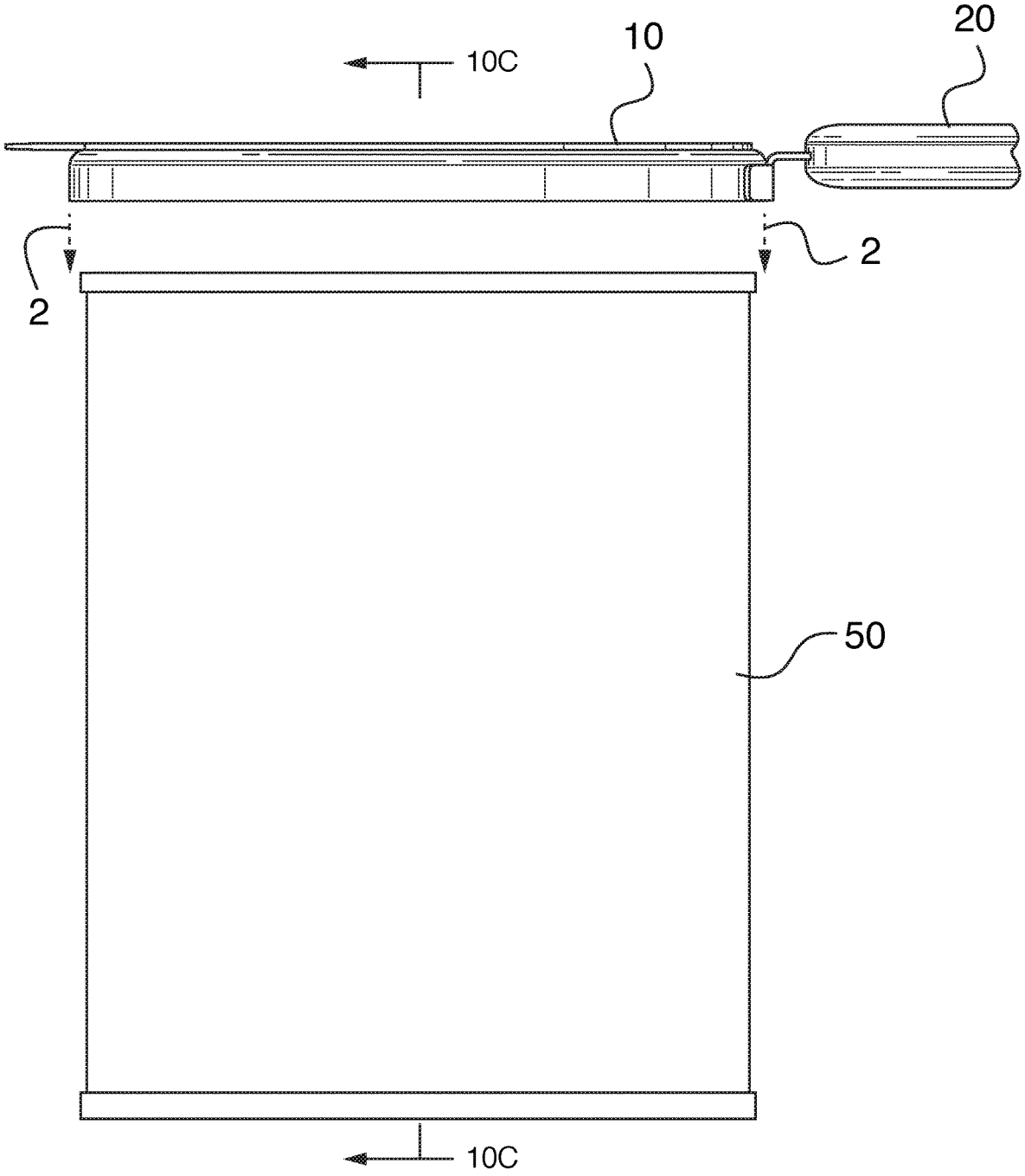
FIG. 10A is an illustration showing the tool of FIG. 1 in a left elevation view being positioned over a cylindrical can in an elevation view.
Figure 10B:
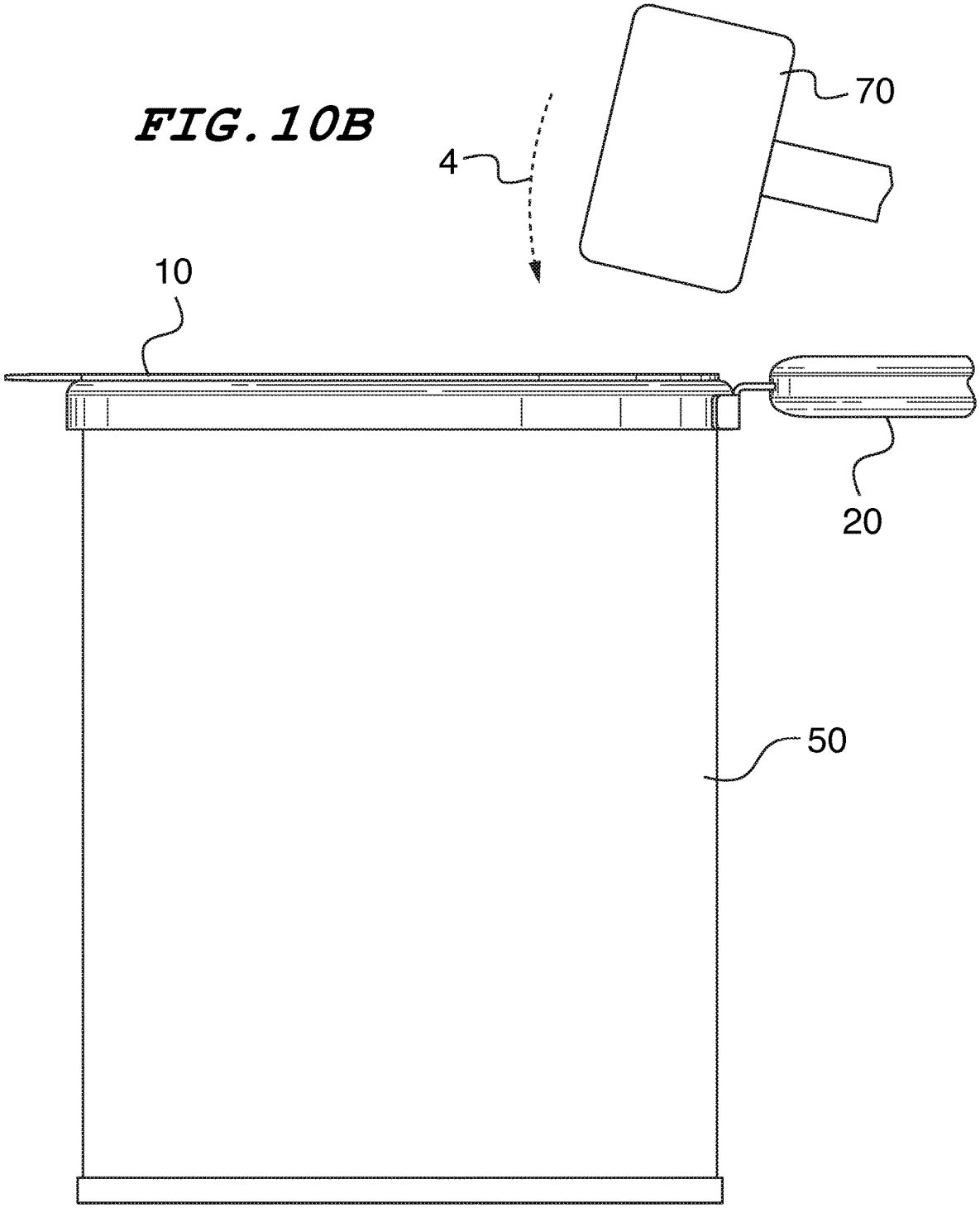
FIG. 10B is an illustration showing the tool of FIG. 1 in a left elevation view positioned on top of the cylindrical can of FIG. 10A to pierce weep holes in an annular channel of the cylindrical can.
Figure 10C:
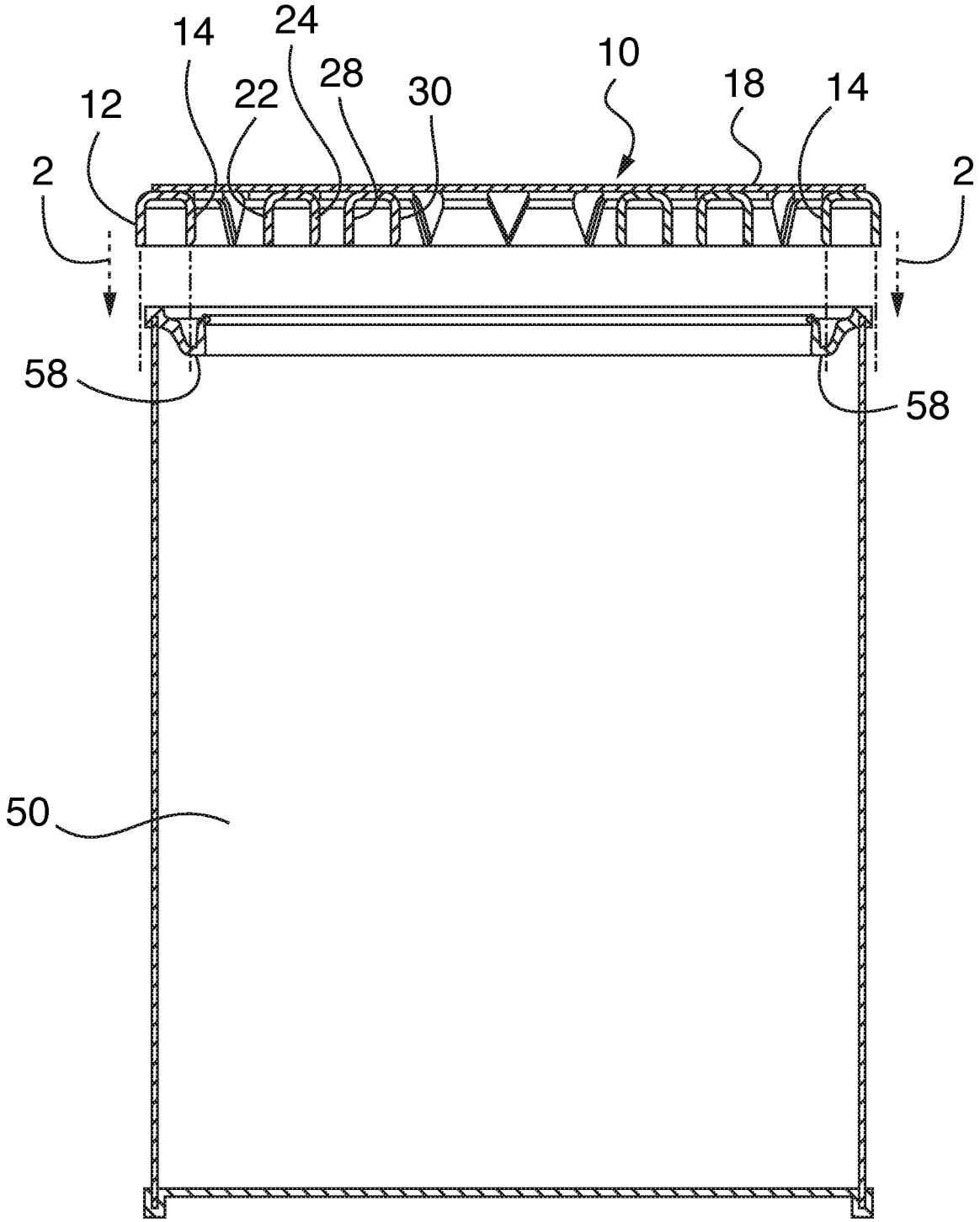
FIG. 10C is a cross-section view of the tool and the cylindrical can of FIG. 10A taken along line 10C-10C in FIG. 10A.
Figure 10D:
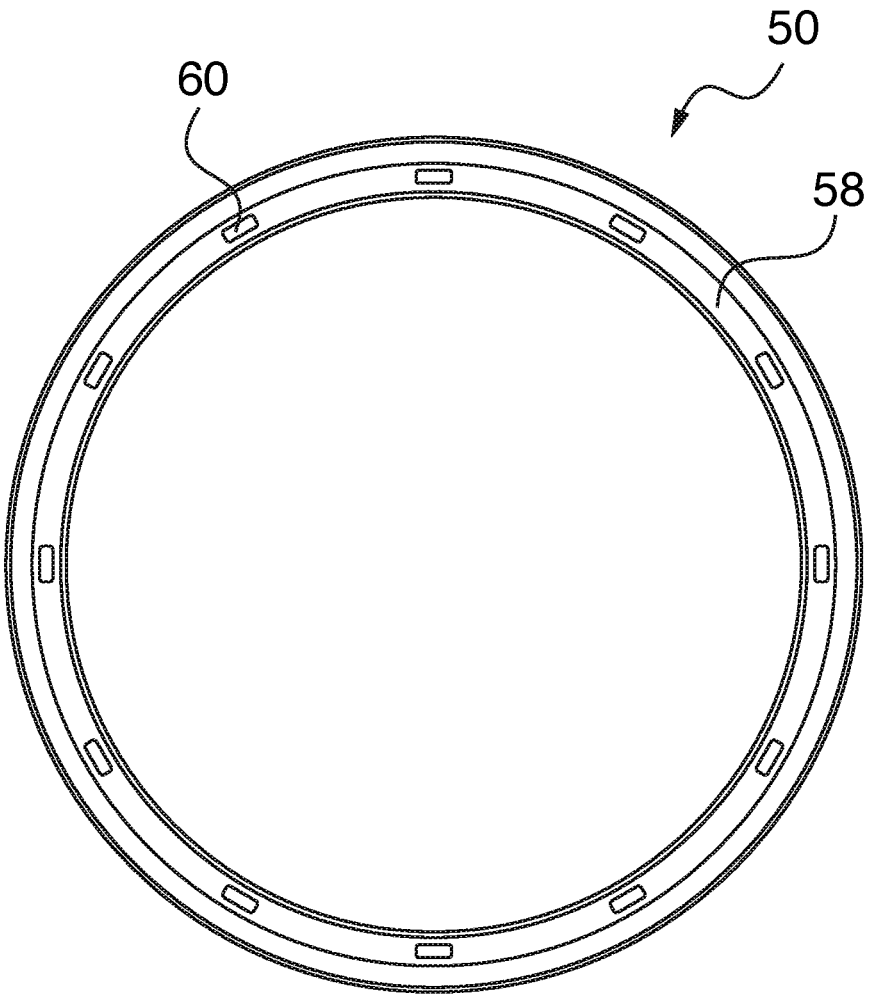
FIG. 10D is a top plan view of the cylindrical can of FIG. 10B showing weep holes pierced by the tool of FIG. 1.

Referring to FIGS. 9A and 9B, a cylindrical can 50 is shown for demonstrating the use of the tool 10 according to an illustrative embodiment. The can 50 can be fabricated for example from steel, aluminum, a polymeric material, or other suitable rigid material. The can 50 is sealed by a circular lid 52 including a lip 54 extending around a circular perimeter of the lid 52. The lid 52 further includes an annular rim 56 seated in an annular channel 58 of the can 50. The annular channel 58 is configured for receiving the annular rim 56 of the lid 52 to create an airtight seal to prevent evaporation of a liquid put in the can 50. A user applying force to the handle 20 can wedge the blade 34 of the tool 10 between the lip 54 of the lid 52 and a top portion of the can 50 to unseat the lid 52 from the can 50 by prying the annular rim 56 out of the annular channel 58.

Referring to FIGS. 10A through 10D, the can 50 is shown with the circular lid 52 removed. In use, a user holding the handle 20 positions the tool 10 over the can 50 and lowers the tool 10 downward in the direction shown by arrows 2 such that the first annular ring 12 fits around the outside of the can 50, and the first plurality of pointed punches 14 are disposed within and contact the annular channel 58. A user applies a force 4 on a top portion of the tool 10 which causes the first plurality of pointed punches 14 to pierce the annular channel 58. The force 4 is beneficially applied as an impact force with a weighted object, for example a blow with a mallet 70. Beneficially, the force 4 is applied multiple times at multiple positions over the first circular perimeter defined by the first plurality of pointed punches 14. Alternatively, force can be applied anywhere on the plate 18. By application of the force 4, weep apertures 60 are created by the first plurality of pointed punches 14 in the annular channel 58. Liquid which accumulates in the annular channel 58 can drain back into the can 50 through the weep apertures 60.

Figure 11A:
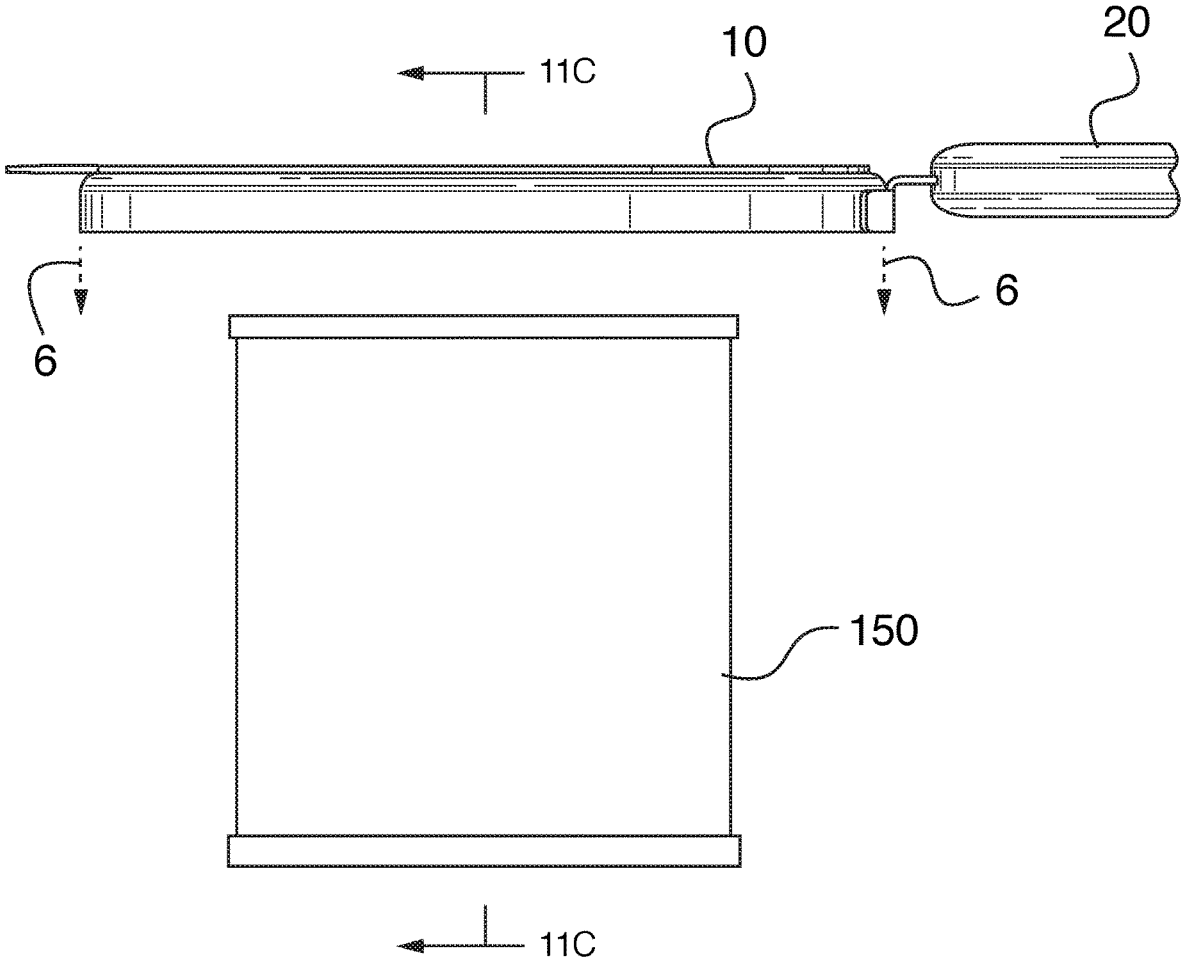
FIG. 11A is an illustration showing the tool of FIG. 1 in a left elevation view being positioned over a cylindrical can in an elevation view.
Figure 11B:
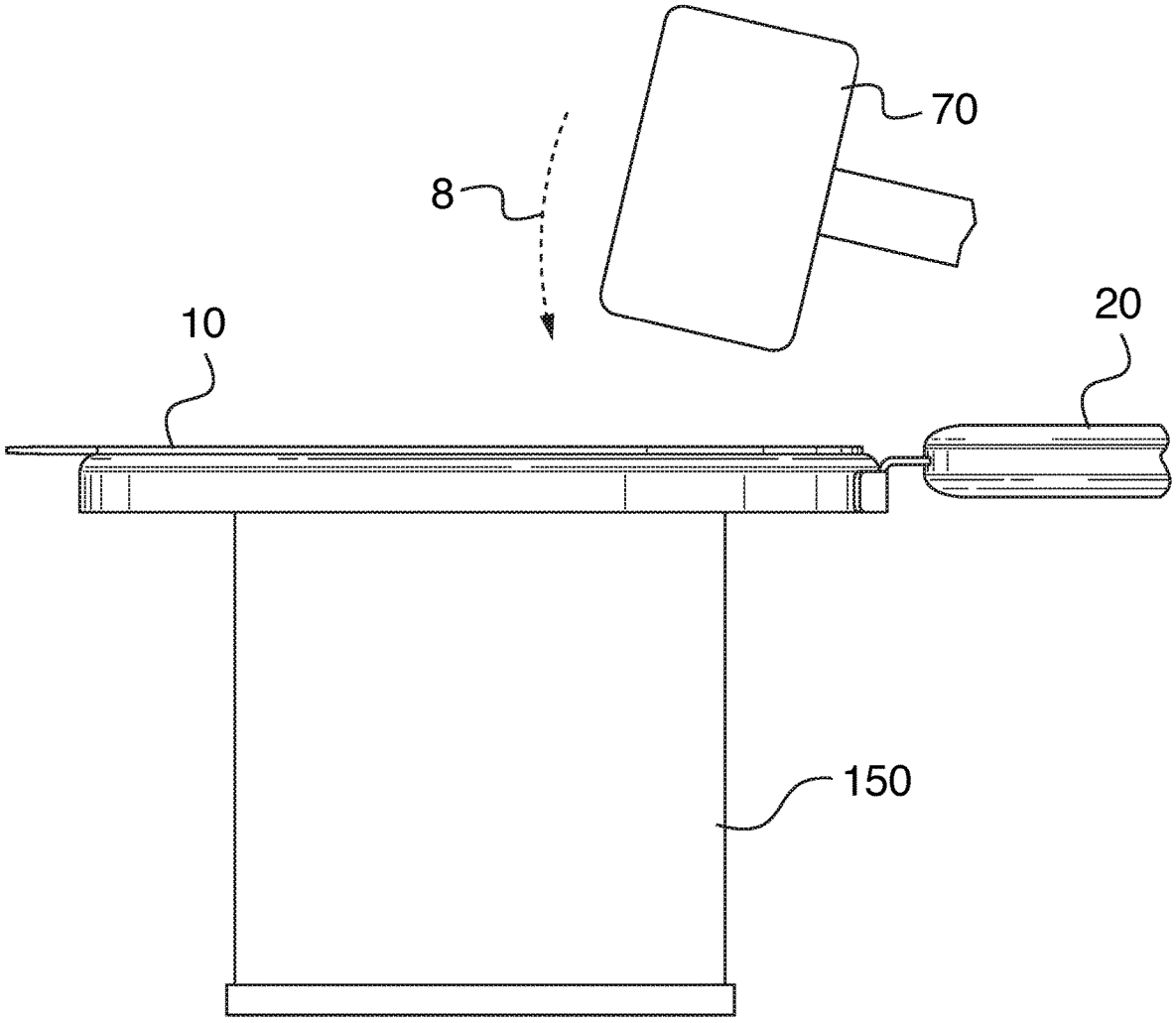
FIG. 11B is an illustration showing the tool of FIG. 1 in a left elevation view positioned on top of the cylindrical can of FIG. 11A to pierce weep holes in an annular channel of the cylindrical can.
Figure 11C:
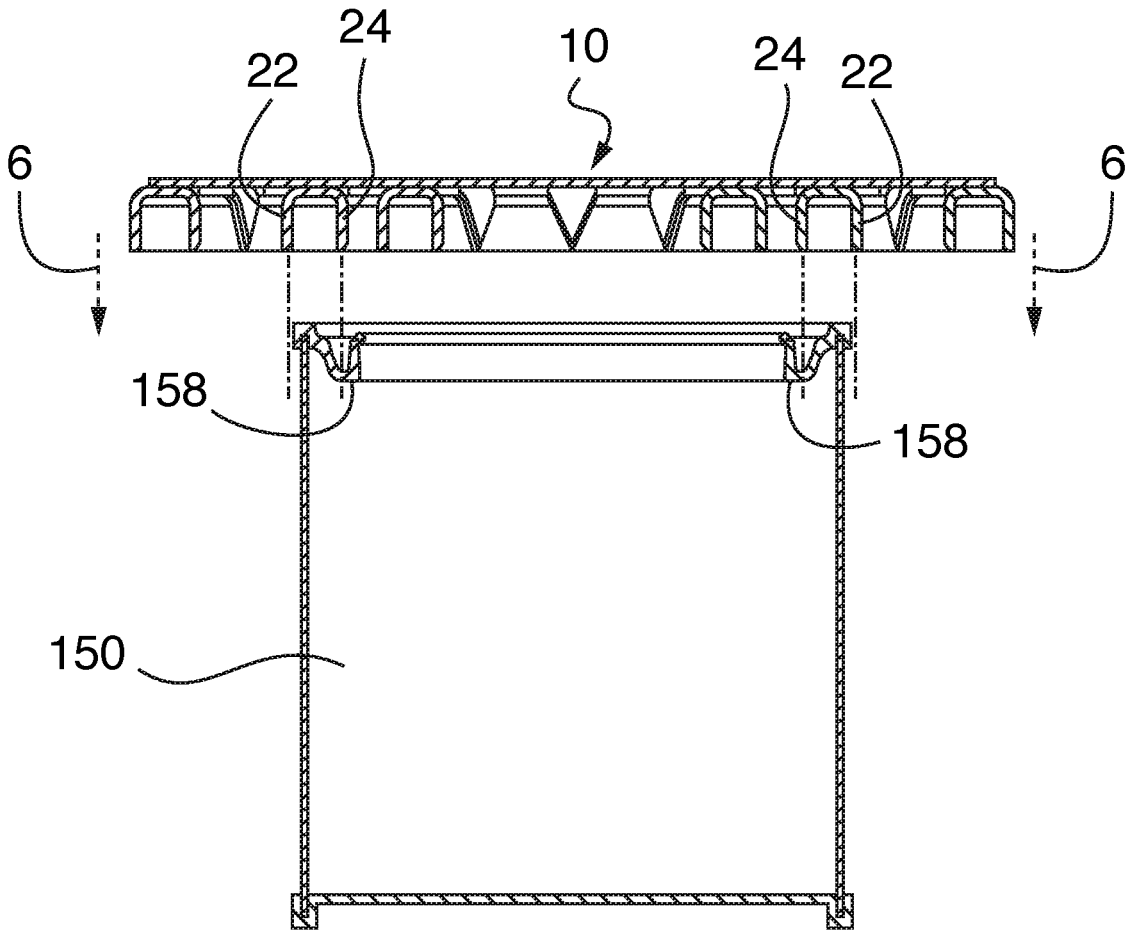
FIG. 11C is a cross-section view of the tool and the cylindrical can of FIG. 11A taken along line 11C-11C in FIG. 11A.

Referring to FIGS. 11A through 11C, a cylindrical can 150 is shown for demonstrating another use of the tool 10 according to an illustrative embodiment. The can 150 includes an annular channel 158 which is configured for receiving a mating portion of a lid to create an airtight seal to prevent evaporation of a liquid put in the can 150. In use, a user holding the handle 20 positions the tool 10 over the can 150 and lowers the tool 10 downward onto the top of the can 150 in the direction shown by arrows 6 such that the second annular ring 22 fits around the outside of the can 150, and the first plurality of pointed punches 24 are disposed within and contact the annular channel 158. The tool 10 is positioned over the can 150 based on the view of the can 150, the second annular ring 22, and the second plurality of pointed punches 24 as seen by a user through one or more of the apertures 36 in the plate 18. The user applies a force 8 on a top portion of the tool 10 which causes the second plurality of pointed punches 24 to pierce the annular channel 158. The force 8 can be applied as an impact force with a weighted object, for example a blow with the mallet 70. Beneficially, the force 8 is applied multiple times at multiple positions above the second circular perimeter defined by the second plurality of pointed punches 24. Alternatively, force can be applied anywhere on the plate 18. By application of the force 8, weep apertures are created by the second plurality of pointed punches 24 in the annular channel 158. Liquid which accumulates in the annular channel 158 can drain back into the can 150 through the weep apertures in the annular channel 158.

The tool 10, configured as a low profile tool as shown, can be conveniently stored with paint brushes, scrapers, spackling knives, and other tools common to the painting and finishing trades, for example by hanging on a hook or peg through a hole 42 in the handle 20.

Figure 12:
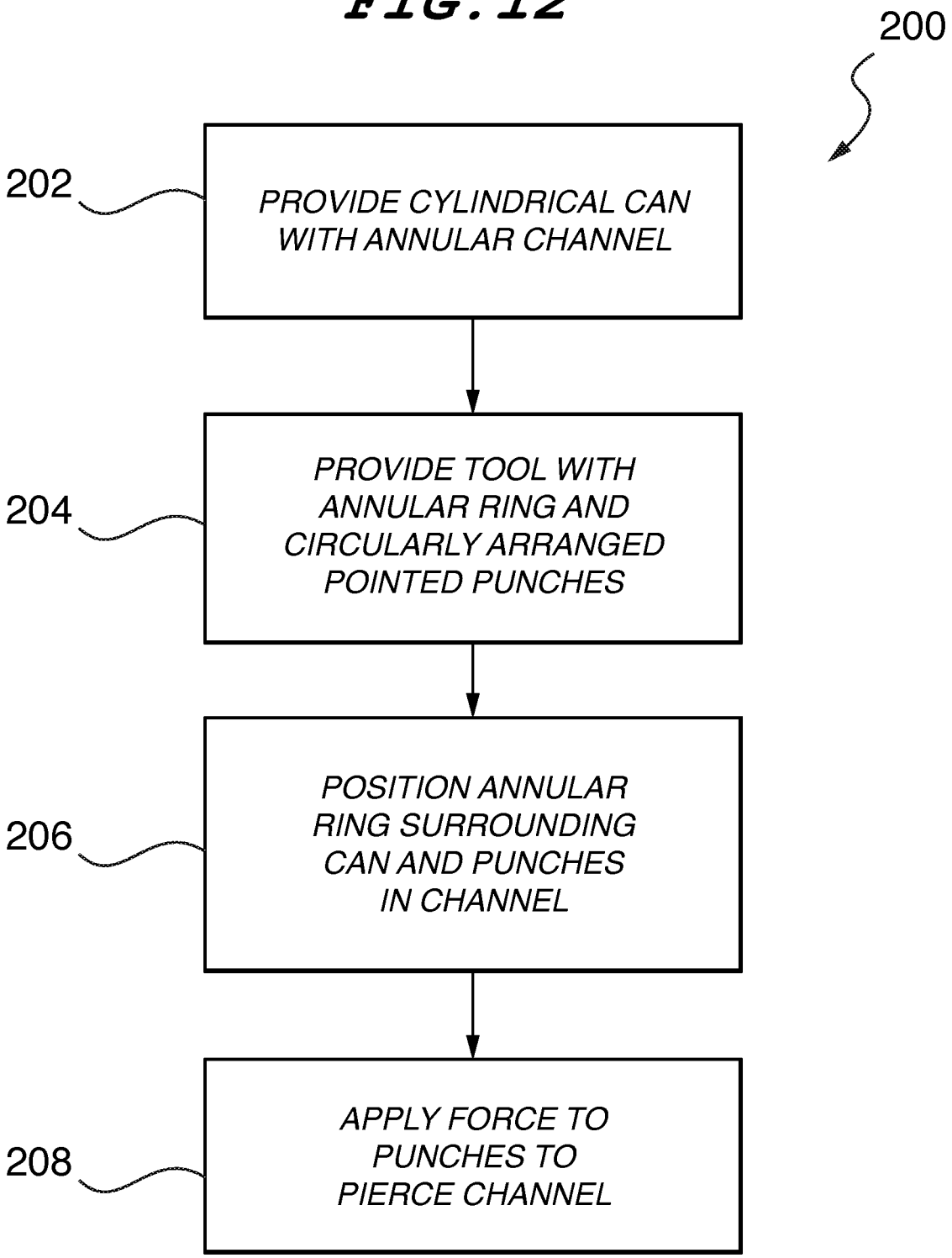
FIG. 12 is a flow chart showing a method of modifying a can.

Referring to FIG. 12, a method 200 of modifying a can is shown. The method 200 is described with reference to the can 50 and the tool 10 described herein. Alternatively, other tools and cans can be used to perform the described method 200. The method 200 includes providing a cylindrical can 50 including an annular channel 58 around an opening of the cylindrical can 50 (step 202). A tool 10 is provided (step 204) including an annular ring 12, including a plurality pointed punches 14 connected to the annular ring 12, concentric with the annular ring 12, inside the annular ring 12, and defining a circular perimeter, and including a handle 20 connected to the annular ring 12 extending away from the annular ring 12. The tool 10 is positioned over the cylindrical can 50 using the handle 20 with the annular ring 12 surrounding the cylindrical can 50 and the plurality of pointed punches 14 disposed within the annular channel 58 of the cylindrical can 50 (step 206). Force is applied to the plurality of pointed punches 14 to pierce the annular channel 58 of the cylindrical can 50 (step 208).

One of ordinary skill in the art will appreciate that features or elements described herein, although set forth in particular combinations, can be used alone or in any combination with the other features or elements. While embodiments have been described in detail above, these embodiments are non-limiting and should be considered as merely exemplary. Modifications and extensions may be developed, and all such modifications are deemed to be within the scope defined by the appended claims.

What is claimed is:

1. A can piercing tool comprising:

a first annular ring;

a first plurality of pointed punches connected to the first annular ring spaced from the first annular ring, concentric with the first annular ring, inside the first annular ring, and defining a first circular perimeter spaced from the first annular ring and inside the first annular ring;

a second annular ring connected to the first annular ring, coplanar with the first annular ring, and inside and spaced from the first circular perimeter;

a second plurality of pointed punches connected to the second annular ring spaced from the second annular ring, concentric with the second annular ring, inside the second annular ring, and defining a second circular perimeter spaced from the second annular ring and inside the second annular ring; and a handle connected to the first annular ring and extending away from the first annular ring.

2. The tool of claim 1, further comprising a blade connected to the first annular ring and extending away from the first annular ring and the handle.

3. The tool of claim 1, wherein the first annular ring and the second annular ring are concentric.

4. The tool of claim 1, further comprising a third annular ring connected to the first annular ring, coplanar with the first annular ring, and inside and spaced from the second circular perimeter; and a third plurality of pointed punches connected to the third annular ring spaced from the third annular ring, concentric with the third annular ring, inside the third annular ring, and defining a third circular perimeter spaced from the third annular ring and inside the third annular ring.

5. The tool of claim 4, wherein the first annular ring, the first circular perimeter, the second annular ring, the second circular perimeter, the third annular ring, and the third circular perimeter are concentric.

6. The tool of claim 1, wherein the handle is substantially coplanar with a plane defined by the first annular ring.

7. A can piercing tool comprising:

a first annular ring;

a first plurality of pointed punches connected to the first annular ring, concentric with the first annular ring, inside the first annular ring, and defining a first circular perimeter;

a second annular ring connected to the first annular ring, coplanar with the first annular ring, and inside the first circular perimeter;

a second plurality of pointed punches connected to the second annular ring, concentric with the second annular ring, inside the second annular ring, and defining a second circular perimeter;

a third annular ring connected to the first annular ring, coplanar with the first annular ring, and inside the second circular perimeter;

a third plurality of pointed punches connected to the third annular ring, concentric with the third annular ring, inside the third annular ring, and defining a third circular perimeter;

a handle connected to the first annular ring and extending away from the first annular ring; and a plate connected to the first annular ring, the first plurality of pointed punches, the second annular ring, the second plurality of pointed punches, the third annular ring, and the third plurality of pointed punches, the plate comprising at least one aperture exposing the second annular ring, the third annular ring, at least one of the second plurality of pointed punches, and at least one of the third plurality of pointed punches.

8. The tool of claim 7, the at least one aperture comprising a plurality of annularly arranged apertures arranged along a fourth circular perimeter running through centers of the annularly arranged apertures.

9. The tool of claim 8, the plurality of annularly arranged apertures comprising a plurality of circular apertures.

10. The tool of claim 7, wherein the first annular ring, the first circular perimeter, the second annular ring, the second circular perimeter, the third annular ring, and the third circular perimeter, are concentric.

11. The tool of claim 7, the plate comprising a blade extending away from the first annular ring and the handle.

12. The tool of claim 7, wherein:

the first annular ring and the first plurality of pointed punches form a first circular u-shaped form connected to the plate;

the second annular ring and the second plurality of pointed punches form a second circular u-shaped form connected to the plate; and the third annular ring and the third plurality of pointed punches form a third circular u-shaped form connected to the plate.

13. A can piercing tool comprising:

a first annular ring;

a first plurality of pointed punches connected to the first annular ring, concentric with the first annular ring, inside the first annular ring, and defining a first circular perimeter, the first annular ring and the first plurality of pointed punches forming a first circular u-shaped form;

a handle connected to the first annular ring and extending away from the first annular ring;

a second annular ring connected to the first annular ring, coplanar with the first annular ring, and inside the first circular perimeter;

a second plurality of pointed punches connected to the second annular ring, concentric with the second annular ring, inside the second annular ring, and defining a second circular perimeter, the second annular ring and the second plurality of pointed punches forming a second circular u-shaped form;

a third annular ring connected to the first annular ring, coplanar with the first annular ring, and inside the second circular perimeter; and a third plurality of pointed punches connected to the third annular ring, concentric with the third annular ring, inside the third annular ring, and defining a third circular perimeter, the third annular ring and the third plurality of pointed punches forming a third circular u-shaped form.

14. A can modification method comprising:

providing a first cylindrical can comprising a first annular channel around an open end of the first cylindrical can;

providing a tool comprising:

a first annular ring comprising a first upstanding circular sidewall;

a first plurality of pointed punches connected to the first annular ring spaced from the first upstanding circular sidewall, concentric with the first annular ring, inside the first annular ring, and defining a first circular perimeter spaced from the first upstanding circular sidewall and inside the first annular ring;

a second annular ring comprising a second upstanding circular sidewall, the second annular ring connected to the first annular ring, coplanar with the first annular ring, and inside and spaced from the first circular perimeter;

a second plurality of pointed punches connected to the second annular ring spaced from the second upstanding circular sidewall, concentric with the second annular ring, inside the second annular ring, and defining a second circular perimeter spaced from the second upstanding circular sidewall and inside the second annular ring; and a handle connected to the first annular ring and extending away from the first annular ring;

positioning the tool over the first cylindrical can using the handle with the first upstanding circular sidewall surrounding the first cylindrical can and the first plurality of pointed punches disposed within the first annular channel of the first cylindrical can; and applying force to the first plurality of pointed punches to pierce the first annular channel of the first cylindrical can.

15. The method of claim 14, further comprising providing the force as an impact force with a weighted object.

16. The method of claim 14, further comprising:

providing a lid comprising an annular rim, the lid removably connected to the first cylindrical can by positioning of the annular rim of the lid in the first annular channel of the first cylindrical can;

providing the tool with a blade connected to the first annular ring and extending away from the first annular ring and the handle; and prying the annular rim out of the first annular channel using the blade by force applied to the handle to remove the lid from the first cylindrical can, wherein the tool is positioned over the first cylindrical can, and the force applied to the first plurality of pointed punches is applied to pierce the first annular channel after the lid is removed.

17. The method of claim 14, further comprising:

providing a second cylindrical can comprising a second annular channel;

positioning the tool over the second cylindrical can using the handle with the second upstanding circular sidewall surrounding the second cylindrical can and the second plurality of pointed punches disposed within the second annular channel of the second cylindrical can; and applying force to the second plurality of pointed punches to pierce the second annular channel of the second cylindrical can.

18. The method of claim 17, further comprising:

providing the tool further comprising a plate connected to the first annular ring, the first plurality of pointed punches, the second annular ring, and the second plurality of pointed punches, the plate comprising at least one aperture exposing the second annular ring and at least one of the second plurality of pointed punches; and positioning the tool over the second cylindrical can based on a view of the second cylindrical can, the second annular ring, and the second plurality of pointed punches through the at least one aperture of the plate.

19. A can piercing tool comprising:

a first annular disk having a first circular central opening and a first upstanding circular sidewall extending from an outer periphery of the first annular disk and spaced from the first circular central opening;

a first plurality of pointed punches connected to the first annular disk, concentric with the first annular disk, inside the first annular disk, spaced from the first upstanding circular sidewall, and defining a first circular perimeter;

a second annular disk having a second circular central opening and a second upstanding circular sidewall extending from an outer periphery of the second annular disk and spaced from the second circular central opening, the second annular disk connected to the first annular disk, coplanar with the first annular disk, and inside the first circular perimeter;

a second plurality of pointed punches connected to the second annular disk, concentric with the second annular disk, inside the second annular disk, spaced from the second upstanding circular sidewall, and defining a second circular perimeter; and a handle connected to the first annular disk and extending away from the first annular disk.

20. The tool of claim 19, further comprising:

a third annular disk having a third circular central opening and a third upstanding circular sidewall extending from an outer periphery of the third annular disk and spaced from the third circular central opening, the third annular disk connected to the first annular disk, coplanar with the first annular disk, and inside the second circular perimeter; and a third plurality of pointed punches connected to the third annular disk, concentric with the third annular disk, inside the third annular disk, spaced from the third upstanding circular sidewall and defining a third circular perimeter.

21. A can piercing tool comprising:

a first annular ring comprising a first upstanding circular sidewall;

a first plurality of pointed punches connected to the first annular ring spaced from the first upstanding circular sidewall, concentric with the first annular ring, inside the first annular ring, and defining a first circular perimeter spaced from the first upstanding circular sidewall and inside the first annular ring;

a second annular ring comprising a second upstanding circular sidewall, the second annular ring connected to the first annular ring, coplanar with the first annular ring, and inside the first circular perimeter;

a second plurality of pointed punches connected to the second annular ring spaced from the second upstanding circular sidewall, concentric with the second annular ring, inside the second annular ring, and defining a second circular perimeter spaced from the second upstanding circular sidewall and inside the second annular ring; and a handle connected to the first annular ring and extending away from the first annular ring.

22. The tool of claim 21, further comprising:

a third annular ring comprising a third upstanding circular sidewall, the third annular ring connected to the first annular ring, coplanar with the first annular ring, and inside the second circular perimeter; and a third plurality of pointed punches connected to the third annular ring spaced from the third upstanding circular sidewall, concentric with the third annular ring, inside the third annular ring, and defining a third circular perimeter spaced from the third upstanding circular sidewall and inside the third annular ring.

23. A can piercing tool comprising:

a first annular ring;

a first plurality of pointed punches connected to the first annular ring, concentric with the first annular ring, inside the first annular ring, and defining a first circular perimeter;

a second annular ring connected to the first annular ring, coplanar with the first annular ring, and inside the first circular perimeter;

a second plurality of pointed punches connected to the second annular ring, concentric with the second annular ring, inside the second annular ring, and defining a second circular perimeter;

a handle connected to the first annular ring and extending away from the first annular ring; and a plate connected to the first annular ring, the first plurality of pointed punches, the second annular ring, and the second plurality of pointed punches, the plate comprising at least one aperture exposing the second annular ring and at least one of the second plurality of pointed punches.

* * * * *